US011518668B2

(12) United States Patent
Caputo

(10) Patent No.: US 11,518,668 B2
(45) **Date of Patent: *Dec. 6, 2022**

(54) KEG SENSOR ASSEMBLIES

(71) Applicant: Hunter Caputo, Tigard, OR (US)

(72) Inventor: Hunter Caputo, Tigard, OR (US)

(73) Assignee: Hunter Caputo, Tigard, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/459,057

(22) Filed: Aug. 27, 2021

(65) Prior Publication Data

US 2021/0387843 A1 Dec. 16, 2021

Related U.S. Application Data

(63) Continuation of application No. 16/810,649, filed on Mar. 5, 2020, now Pat. No. 11,117,792.

(60) Provisional application No. 62/814,141, filed on Mar. 5, 2019.

(51) Int. Cl.
*B67D 1/08* (2006.01)

(52) U.S. Cl.
CPC ..... *B67D 1/0871* (2013.01); *B67D 1/0841* (2013.01)

(58) Field of Classification Search
CPC ..... B67D 1/0871; B67D 1/0841
USPC ..... 222/23
See application file for complete search history.

(56) References Cited

U.S. PATENT DOCUMENTS 4,711,377 A 12/1987 Brown
4,941,593 A 7/1990 Hicks et al.
4,979,641 A 12/1990 Turner
5,431,302 A 7/1995 Tulley et al.
5,636,763 A 6/1997 Furness
5,641,094 A 6/1997 Wunsch
5,908,142 A 6/1999 Sacchetti
5,909,825 A 6/1999 Lydford
6,856,251 B1 2/2005 Tietsworth et al.
7,131,560 B2 11/2006 Hammond
8,757,195 B2 6/2014 Gitlin, Jr. et al.
(Continued)

FOREIGN PATENT DOCUMENTS

WO 2016/112323 A1 7/2016

OTHER PUBLICATIONS

Office Action prepared by the U.S. Patent and Trademark Office for U.S. Appl. No. 16/810,649, filed Feb. 17, 2021, 14 pages.

*Primary Examiner* — Paul R Durand
*Assistant Examiner* — Michael J. Melaragno
(74) *Attorney, Agent, or Firm* — Chernoff, Vihauer, McClung & Stenzel, LLP

(57) ABSTRACT

Keg sensors and keg sensor assemblies are disclosed. In some embodiments, the keg sensor may include a main body and a first connector attached to the main body and configured to be connected to a keg dispensing coupler. The keg dispensing coupler may be configured to be moved between a closed position and an open position; The keg sensor may additionally include a second connector attached to the main body and configured to be connected to a valve of a keg. The keg sensor may further include a sensor assembly attached to the main body and configured to detect one or more operating parameters of liquid dispensed, via the keg dispensing coupler, from the keg through the keg sensor. In some embodiments, the keg sensor assembly may include a keg sensor and a stack cage assembly. The stack cage assembly may include a cage sized to surround the keg sensor.

14 Claims, 12 Drawing Sheets

(56) References Cited

U.S. PATENT DOCUMENTS

| | | | | |
|---|---|---|---|---|
| 8,880,427 | B1 | 11/2014 | Jones | |
| 8,925,382 | B1 * | 1/2015 | Beal | G01F 23/14 73/299 |
| 8,991,653 | B2 | 3/2015 | Paulitsch | |
| 10,506,308 | B1 | 12/2019 | Neidhart et al. | |
| 10,752,489 | B1 | 8/2020 | Alger | |
| 11,117,792 | B2 * | 9/2021 | Caputo | B67D 1/0831 |
| 2004/0041709 | A1 | 3/2004 | Forster | |
| 2006/0113322 | A1 | 6/2006 | Maser et al. | |
| 2006/0157515 | A1 | 7/2006 | Oswald | |
| 2010/0243676 | A1 | 9/2010 | Bax et al. | |
| 2011/0121020 | A1 | 5/2011 | Springer | |
| 2012/0059513 | A1 | 3/2012 | Perkins et al. | |
| 2013/0056495 | A1 | 3/2013 | Watts | |
| 2013/0314244 | A1 | 11/2013 | Hershberger et al. | |
| 2016/0264394 | A1 | 9/2016 | Hershberger et al. | |
| 2016/0355389 | A1 | 12/2016 | Bursey et al. | |
| 2016/0374519 | A1 * | 12/2016 | Murphy | A47K 10/424 222/23 |
| 2017/0260037 | A1 * | 9/2017 | Dalton | B67D 1/0829 |
| 2017/0297890 | A1 | 10/2017 | Herlin | |
| 2017/0337496 | A1 | 11/2017 | Jones | |
| 2018/0208448 | A1 | 7/2018 | Zimmerman et al. | |
| 2018/0273370 | A1 | 9/2018 | Raguzin | |
| 2018/0313684 | A1 | 11/2018 | Crosier et al. | |
| 2019/0330041 | A1 | 10/2019 | Fire | |
| 2020/0055720 | A1 | 2/2020 | Volfstun et al. | |

* cited by examiner

KEG SENSOR ASSEMBLIES

CROSS-REFERENCE TO RELATED APPLICATIONS

This application is a continuation of U.S. patent application Ser. No. 16/810,649, filed on Mar. 5, 2020 and entitled "Keg Sensor Assemblies," which claims the benefit of U.S. Provisional Patent Application Ser. No. 62/814,141, filed on Mar. 5, 2019 and entitled "Keg Sensor Assemblies." The complete disclosures of the above applications are hereby incorporated by reference for all purposes.

TECHNICAL FIELD

The present disclosure relates to keg sensor assemblies that may be used to monitor the remaining amount in kegs at dispensing locations.

BACKGROUND

Small breweries and distributors that place kegs at dispensing locations (such as tap houses, restaurants, and bars) typically do not have the resources to manually check their kegs to determine the amounts left in the kegs and whether the kegs are being used in optimal conditions (e.g., temperature, etc.). Therefore, there is a risk that their kegs will run empty and the dispensing locations will simply replace their kegs with their competitors' kegs. Additionally, there is a risk that personnel at the dispensing locations may improperly handle the kegs and dispense drinks (e.g., beer) from the kegs at less than optimal conditions (e.g., at too high a temperature), which may reflect poorly on the small breweries and distributors of the kegs.

What is needed is a sensor assembly for kegs that can monitor the remaining amount in the kegs and also whether the drinks are being dispensed under optimal conditions at dispensing locations.

SUMMARY

The present disclosure provides a keg sensor. In some embodiments, the keg sensor may include a main body and a first connector attached to the main body and configured to be connected to a dispensing coupler. The dispensing coupler may be configured to be moved between a closed position and an open position. The keg sensor may additionally include a second connector attached to the main body and configured to be connected to a valve of a keg. The keg sensor may further include a sensor assembly attached to the main body and configured to detect one or more operating parameters of liquid dispensed from the keg through the keg sensor.

The present disclosure also provides a keg sensor assembly. In some embodiments, the keg sensor assembly may include a keg sensor and a stack cage assembly. The stack cage assembly may include a cage sized to surround the keg sensor. The cage may have upper and lower channels. The lower channel may be configured to receive an upper portion of the keg and the upper channel being configured to support a lower portion of another keg.

DETAILED DESCRIPTION

Various embodiments of keg sensor assemblies according to the present disclosure are described below and illustrated in the associated drawings and appendices. Unless otherwise specified, a keg sensor assembly may contain at least one of the structure, components, functionality, and/or variations described, illustrated, and/or incorporated herein. Furthermore, the structures, components, functionalities, and/or variations described, illustrated, and/or incorporated herein in connection with the present teachings may be included in other driver accessories. The following description of various embodiments is merely illustrative in nature and is in no way intended to limit the disclosure, its application, or uses. Additionally, the advantages provided by the embodiments, as described below, are illustrative in nature and not all embodiments provide the same advantages or the same degree of advantages.

The keg sensor assemblies of the present disclosure are intended to monitor the amount remaining in kegs and/or to determine whether the drinks from those kegs are being dispensed under optimal conditions.

Figure 1:
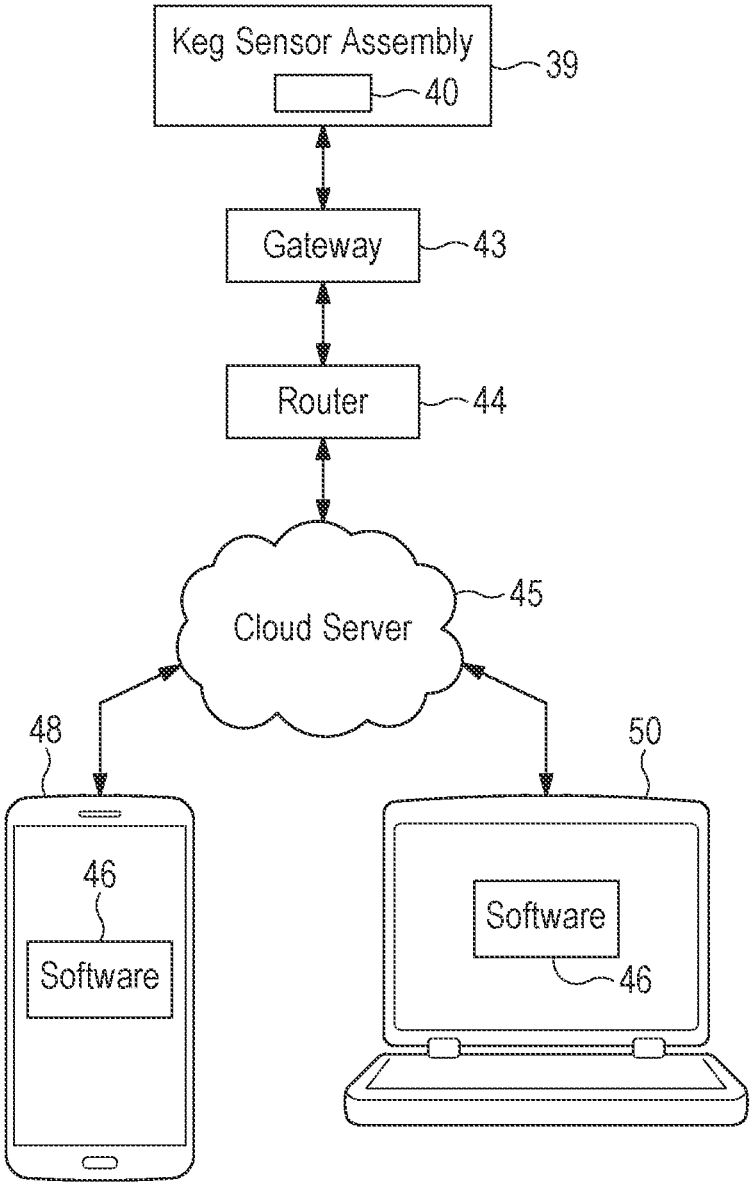
FIG. 1 is a block diagram showing a keg sensor assembly and other components that communicate with the keg sensor assembly.
Figure 2:
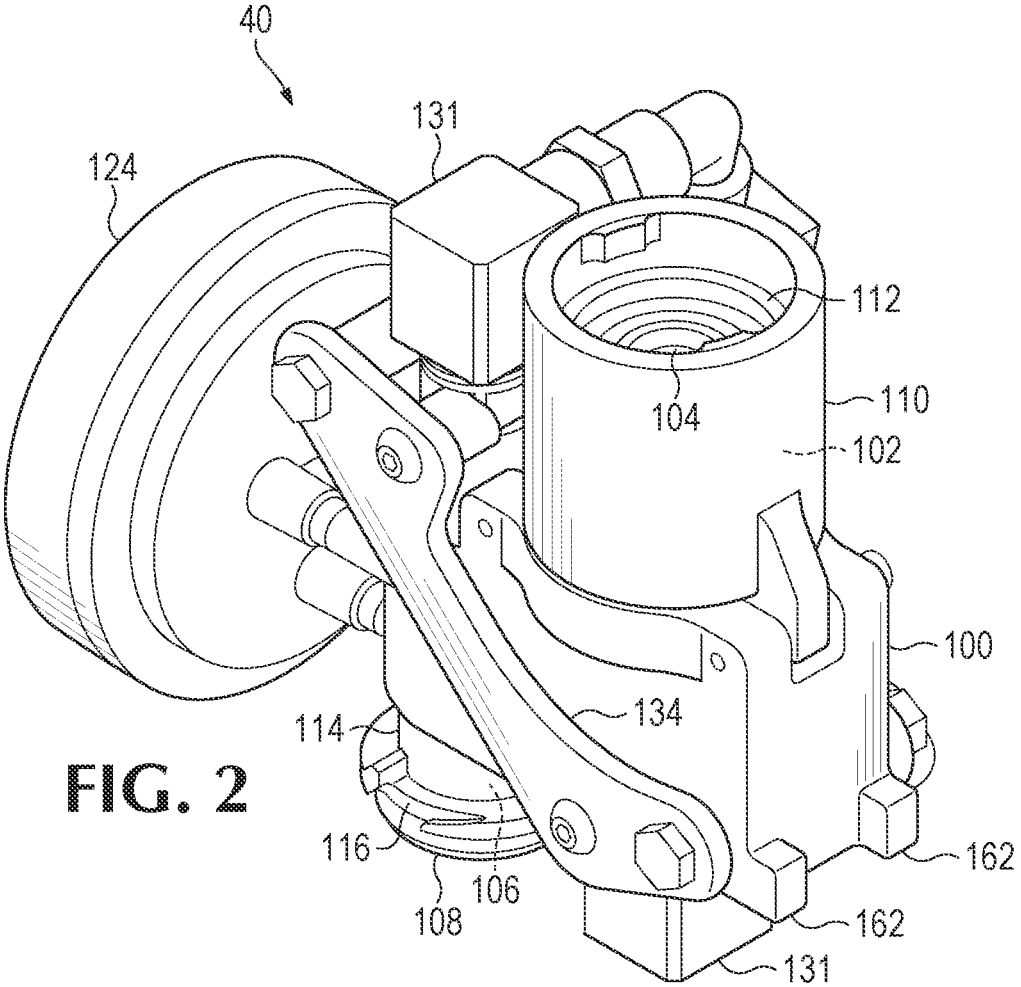
FIG. 2 is an isometric view of an example of a keg sensor of the keg sensor assembly of FIG. 1.
Figure 3:
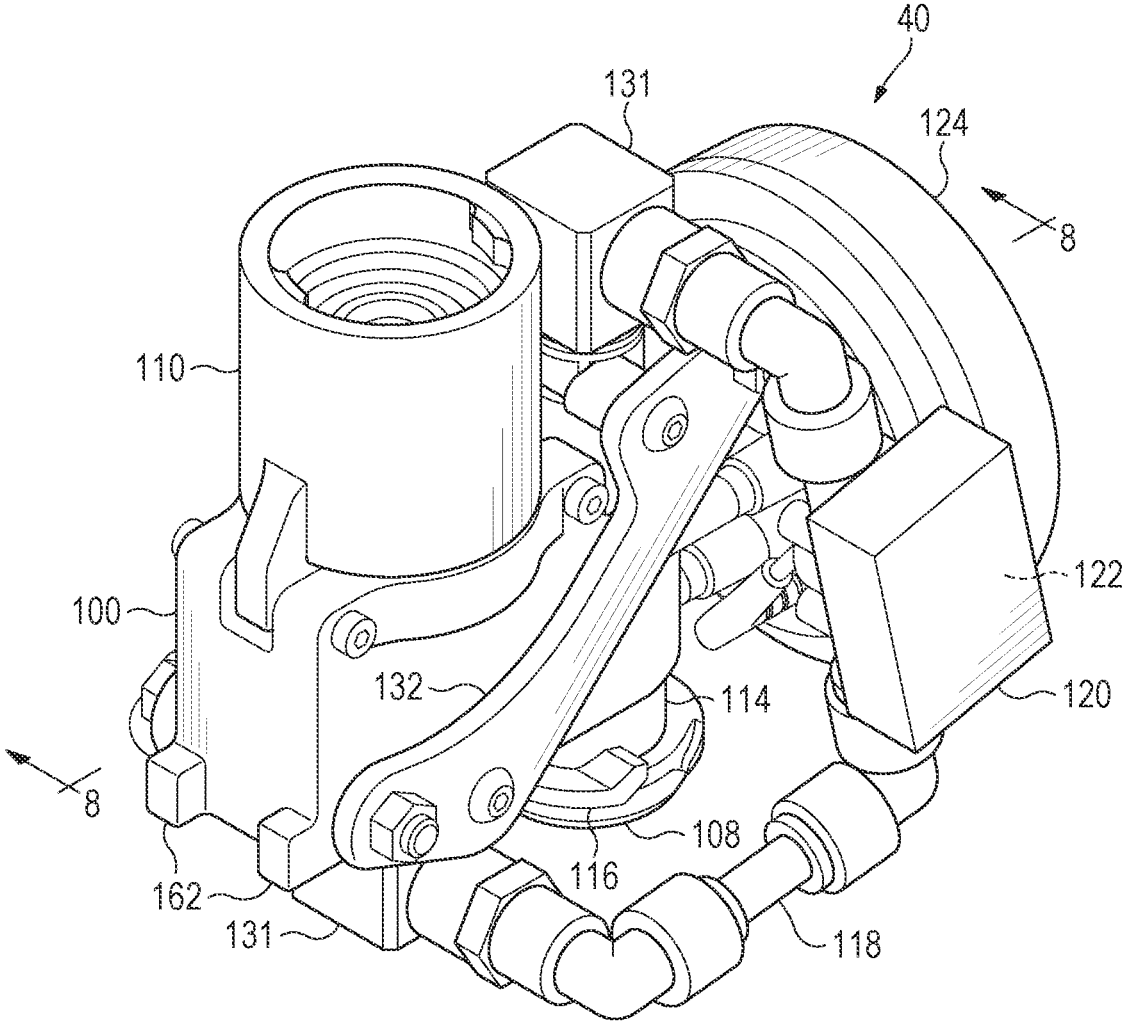
FIG. 3 is another isometric view of the keg sensor of FIG. 2.
Figure 4:
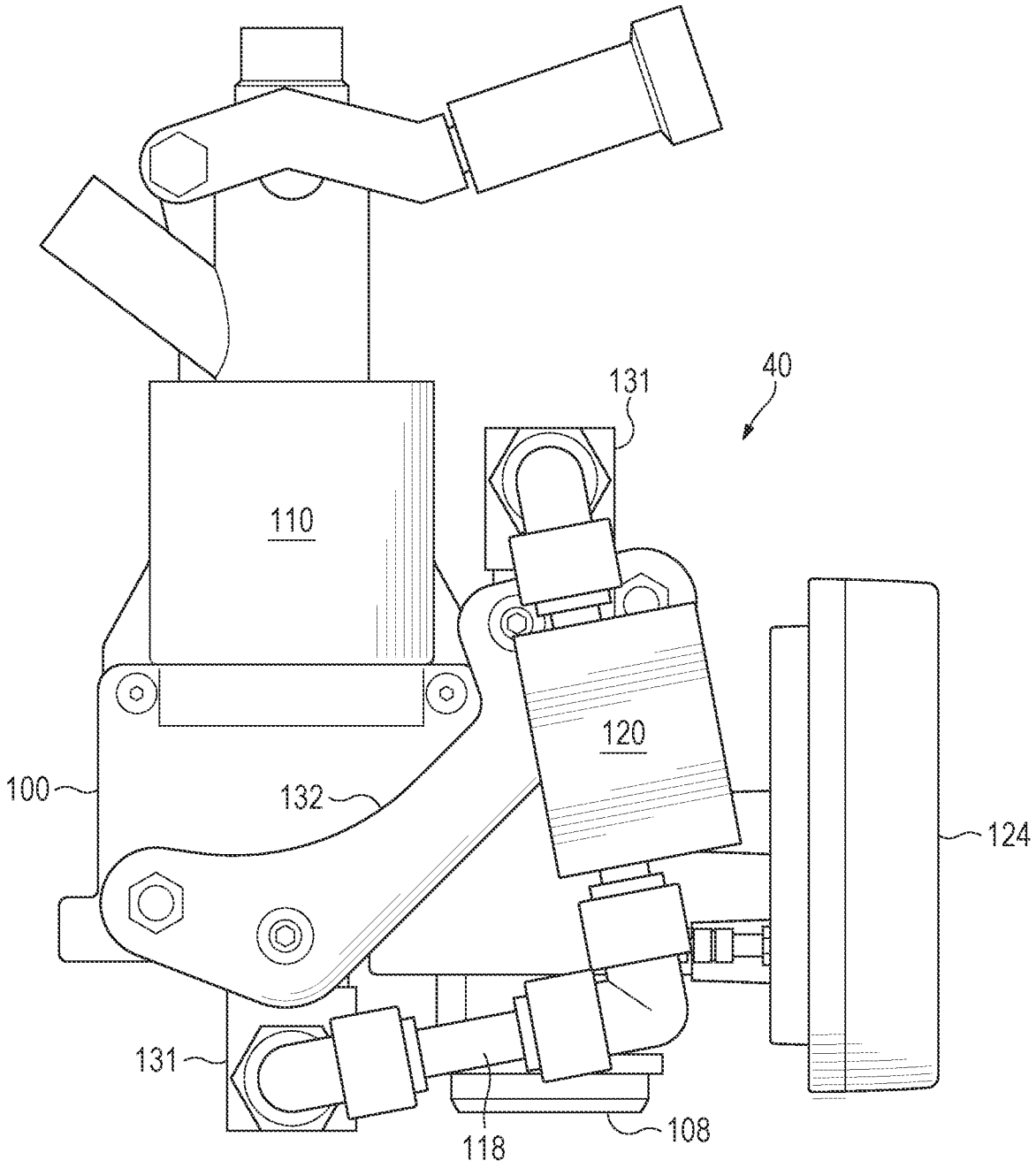
FIG. 4 is a side view of the keg sensor of FIG. 2 with a keg dispensing coupler attached to the keg sensor and in a closed position.
Figure 5:
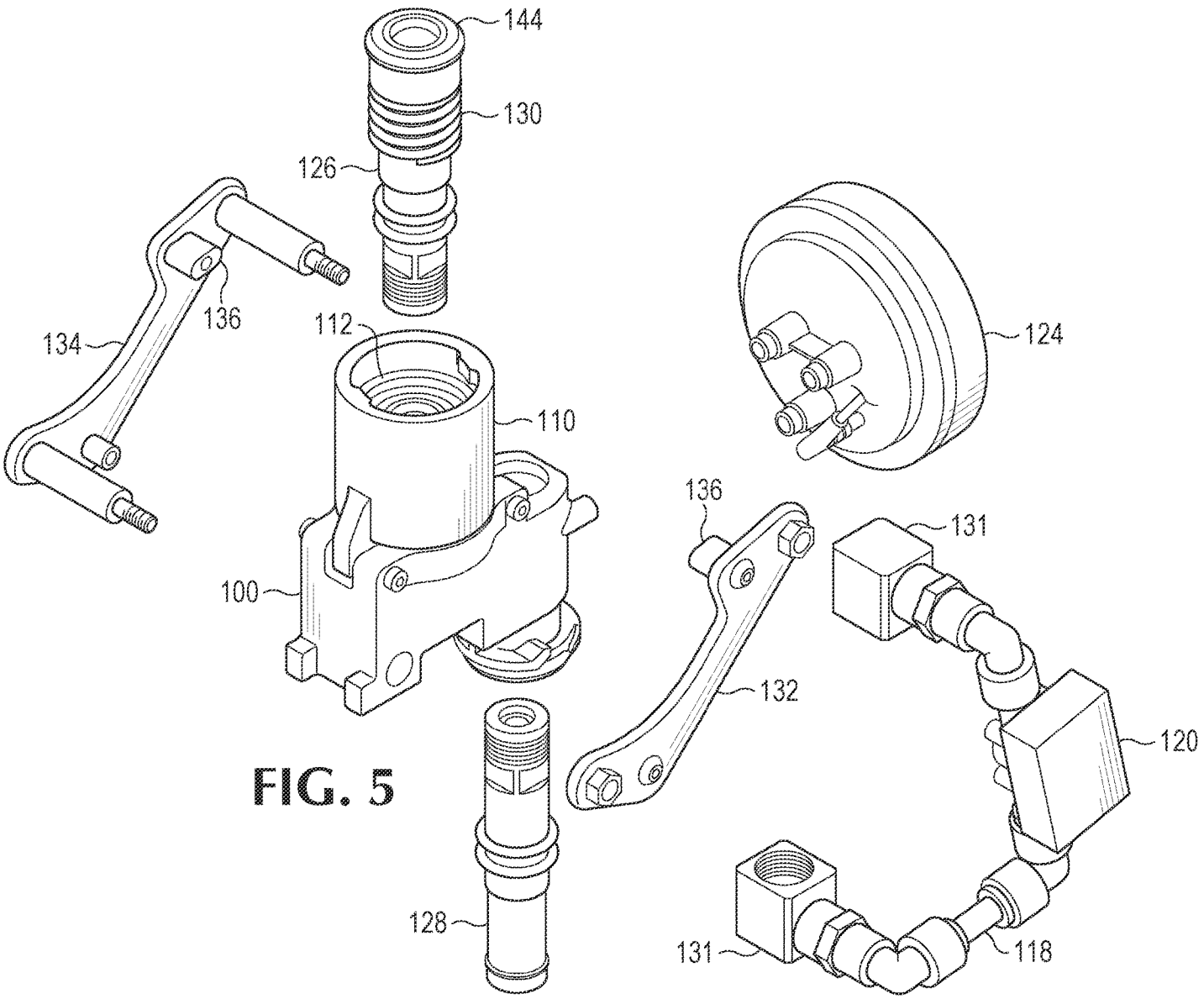
FIG. 5 is an exploded view of the keg sensor of FIG. 2.

Referring to FIG. 1, an example of a keg sensor assembly 39 and other components that communicate with the keg sensor assembly are shown. Keg sensor assembly 39 includes a keg sensor 40 that is attached to a valve (e.g., Sankey valve) of each keg of a brewery or distributor before the kegs are delivered to the dispensing locations of their customers (such as tap houses, restaurants, and bars). When delivered, liquid is dispensed from the keg by connecting a coupler to keg sensor of keg sensor assembly. The keg sensor remains attached while the liquid in the keg is dispensed. The keg sensor exchanges data with a cloud server 45 via a gateway 43 and/or a router 44 (through wired and/or wireless communications) and the data may be analyzed and displayed by software 46 displayed on smart phones, tablets, smart TVs, controller boxes, and/or computers of the brewery or distributor (such as shown at 48 and 50).

Referring to FIGS. 2-5, keg sensor 40 of keg sensor assembly 39 is shown. Keg sensor 40 includes any suitable structure configured to be attached to a valve of a keg, to receive a keg dispensing coupler, and to fluidly connect the keg dispensing coupler and the valve. Keg sensor 40 includes a main body 100. The main body includes a first channel 102 having an upper opening 104 and a second channel 106 having a lower opening 108. In the example shown in FIGS. 2-5, the first and second channels are spaced and parallel to each other. However, other examples of keg sensor 40 may include first and second channels that are not parallel and/or overlap with each other (i.e., not spaced from each other). A third channel 107 (shown in FIG. 8) within the main body fluidly connects first channel 102 and second channel 106 to allow gas (introduced from a gas source fluidly connected to the keg dispensing coupler) to move from the first channel to the second channel.

Keg sensor 40 also includes a first connector or spear tap 110 attached to main body 100. The first connector is configured to connect to or receive a keg dispensing coupler. Spear tap 110 includes a plurality of threads 112 configured to connect and secure a keg dispensing coupler to the keg sensor. In the example shown in FIGS. 2-5, plurality of threads 112 are configured to receive and secure a keg dispensing coupler that is a Sankey coupler type D. In other embodiments, the plurality of threads of first connector 102 may be configured to receive and secure other types of keg dispensing couplers, such as A couplers, G couplers, M couplers, S couplers, or U couplers. Although first connector 110 is shown to be a separate component attached to main body 100, other examples of keg sensor 40 may include first connector 110 formed with main body 100.

Additionally, keg sensor 40 includes a second connector or connector shaft 114 that is formed with main body 100 adjacent to lower opening 108. Second connector 114 includes a plurality of threads 116 configured to connect and be secured to a valve of a keg. In the example shown in FIGS. 2-5, the connector shaft and threads are designed to connect to valves that are Sankey valve type D. In other embodiments, connector shaft 114 and threads 116 may be designed to connect to other types of valves, such as German keg valves, European keg valves, etc. Although connector shaft 114 is shown to be formed with main body 100, other examples of keg sensor 40 may include a connector shaft 114 that is attached to main body 100.

Although connector shaft 114 and threads 116 are configured to be connected to a valve of a keg that is the same connection type as spear tap 110 and threads 112 (i.e., Sankey valve type D and Sankey coupler type D, respectively), other embodiments of keg sensor 40 may include connector shaft 114 and threads 116 that are configured to be connected to a valve of a keg that is of a different connection type as the spear tap and threads. For example, connector shaft 114 and threads 116 may be configured to be connected to German keg valves or European keg valves even though spear tap 110 and threads 112 are configured to receive a keg dispensing coupler that is a Sankey coupler type D. Alternatively, connector shaft 114 and threads 116 may be configured to be connected to a valve of the Sankey valve type D even though spear tap 110 and threads 112 are configured to receive a keg dispensing coupler that is an A, G, M, S, or U coupler.

Keg sensor 40 additionally includes tubing 118 that fluidly connects first channel 102 and second channel 106. In the example shown in FIGS. 2-5, tubing 118 fluidly connects first channel 102 at an end opposed to upper opening 104 and second channel 106 at an end opposed to lower opening 108. Tubing 118 may include any suitable number of elbows and connectors. Tubing 118 allows liquid dispensed from the keg to flow from second channel 106 to first channel 102 through the keg dispenser coupler.

Moreover, keg sensor 40 includes a sensor assembly 120, which may be attached to main housing 100. Sensor assembly 120 includes any suitable sensor(s) 122 configured to detect one or more operating parameters, such as flow, pour volume, pour frequency, temperature, time, location, density, pH, color, alcohol content, turbidity, sulfur dioxide, dissolved carbon dioxide content, protein stability, and/or other suitable parameters, and to provide the sensor data to a control box assembly 124. For example, sensor assembly 120 may include one or more sensors 122 to measure flow and to measure temperature (of the keg sensor and/or the liquid flowing through the tubing). Control box assembly 124 includes components (e.g., receivers, transmitters, processors, memory) that exchanges data with cloud server 45 via gateway 43 and/or router 44, as discussed above for FIG. 1. In some examples, one or more sensors 122 may be part of the control box assembly in addition to, or instead of, sensor assembly 120.

Figure 8:
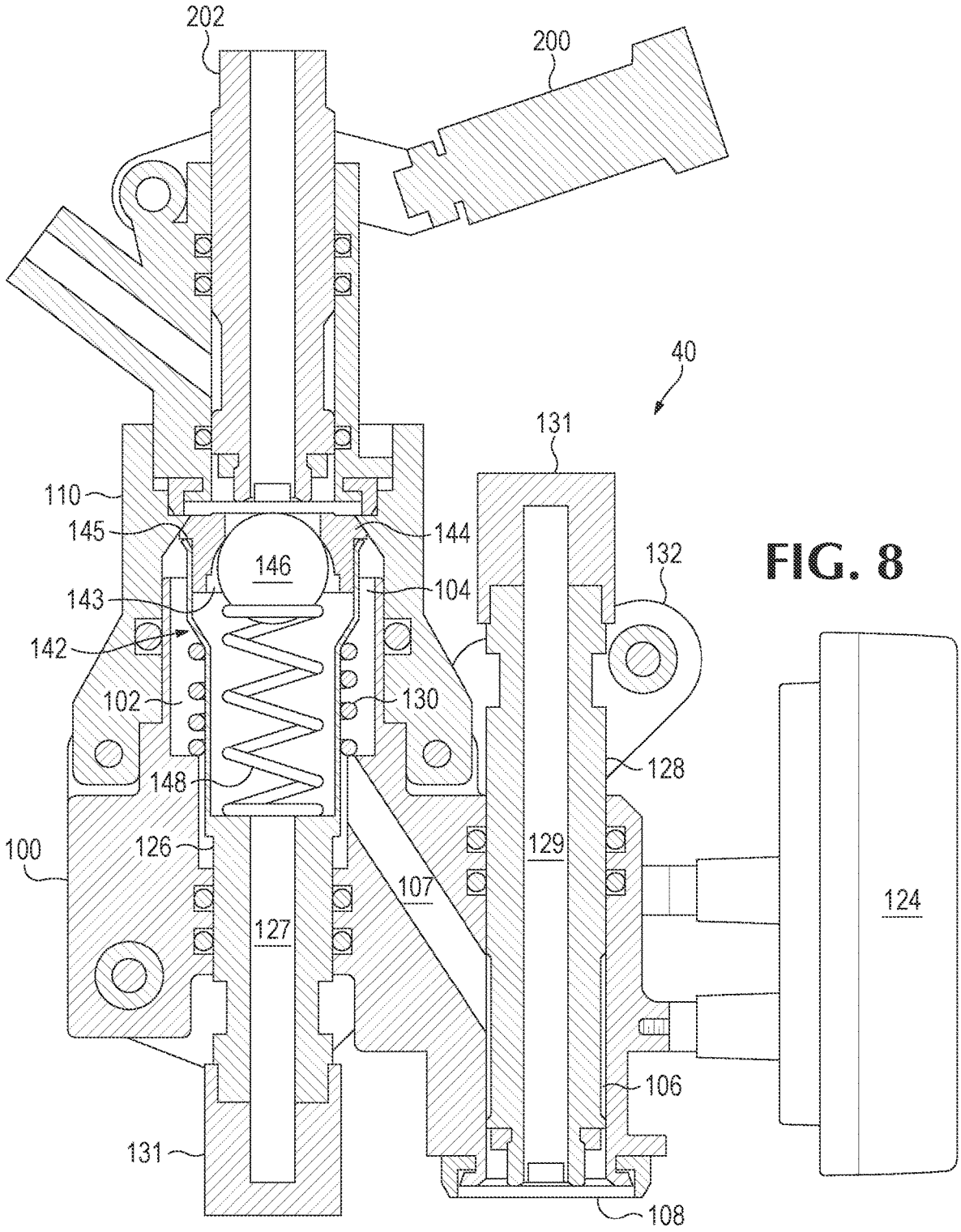
FIG. 8 is a partial sectional view of the keg sensor of FIG. 2 taken along lines 8-8 in FIG. 3, showing a keg dispensing coupler attached to the keg sensor and in a closed position.

Furthermore, keg sensor 40 includes an upper shaft 126 that is slidably received in first channel 102, and a lower shaft 128 that is slidably received in second channel 106 (as shown in FIG. 8). The upper shaft includes an upper shaft channel 127 along the length of the upper shaft, and the lower shaft includes a lower shaft channel 129 along the length of the lower shaft. The ends of the upper and lower shaft (i.e., ends that are opposed to the upper and lower openings of the first and second channels, respectively) include threads that connect to elbows 131 of tubing 118. The keg sensor also includes an upper shaft spring 130 that is positioned within first channel 102 and configured to urge the upper shaft toward upper opening 104.

Figure 7:
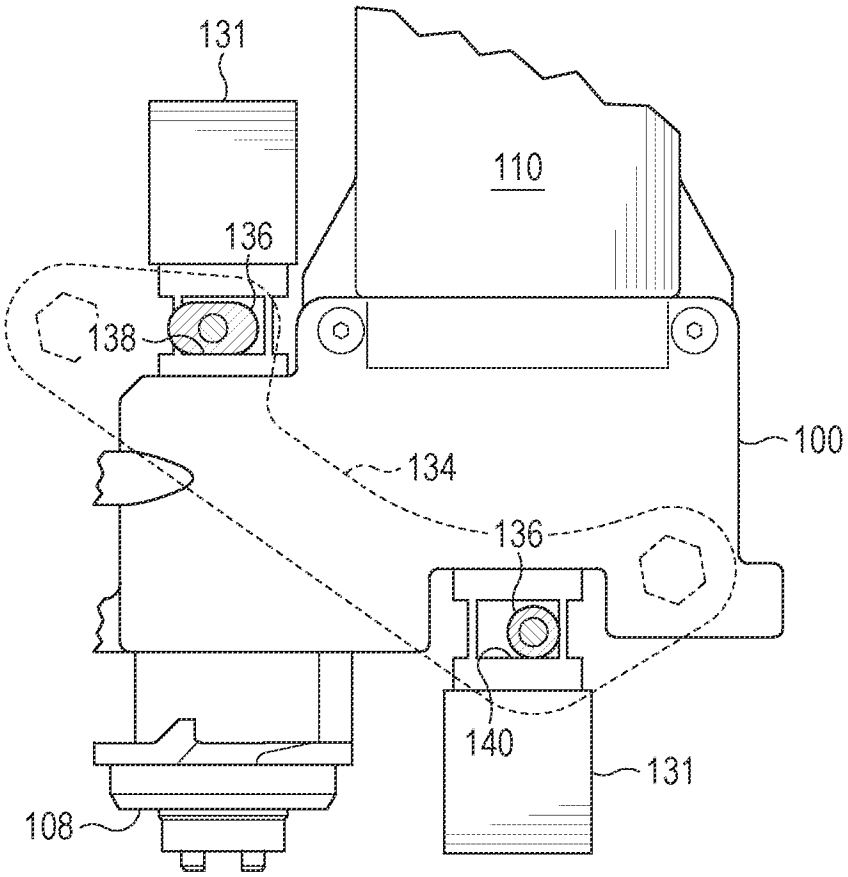
FIG. 7 is the partial view of FIG. 6 showing the side lever, upper shaft, and lower shaft when a keg dispensing coupler is attached to the keg sensor and is in an open position.
Figure 6:
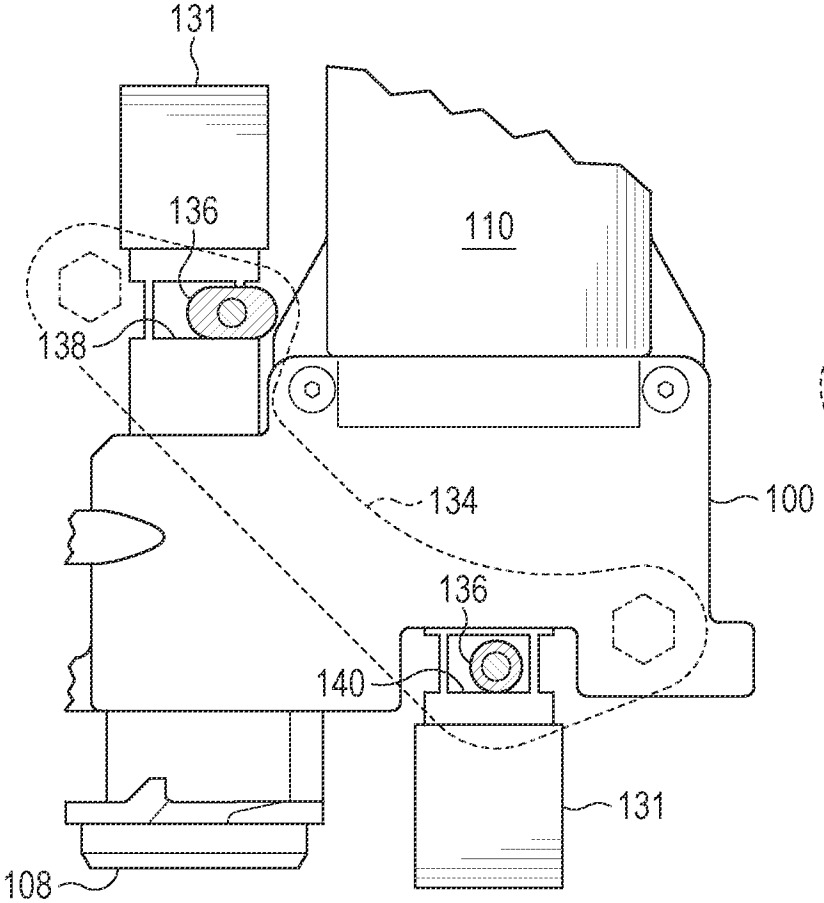
FIG. 6 is a partial view of the keg sensor of FIG. 2 showing a side lever connected to an upper shaft and a lower shaft when a keg dispensing coupler is attached to the keg sensor and is in a closed position.

Additionally, keg sensor 40 includes side levers 132 and 134 that are pivotably attached to main body 100 and slidably attached to upper shaft 126 and lower shaft 128 to mechanically connect those shafts such that, when the upper shaft moves away from the upper opening (in response to a keg dispensing coupler being attached to the keg sensor and moved from the closed position to the open position), the lower shaft moves toward the lower opening. Side levers 132 and 134 include cams 136 that are slidably received in apertures 138 and 140 of upper and lower shafts, respectively, as shown in FIGS. 6-7. FIG. 6 shows the positions of the upper shaft, side levers, and the lower shaft when the attached keg dispensing coupler is in the closed position (i.e., no gas introduced into and no liquid dispensed from the keg), and FIG. 7 shows the positions of the upper shaft, side levers, and the lower shaft when the attached keg dispensing coupler is in the open position (i.e., gas introduced and liquid dispensed from the keg).

Figure 9:
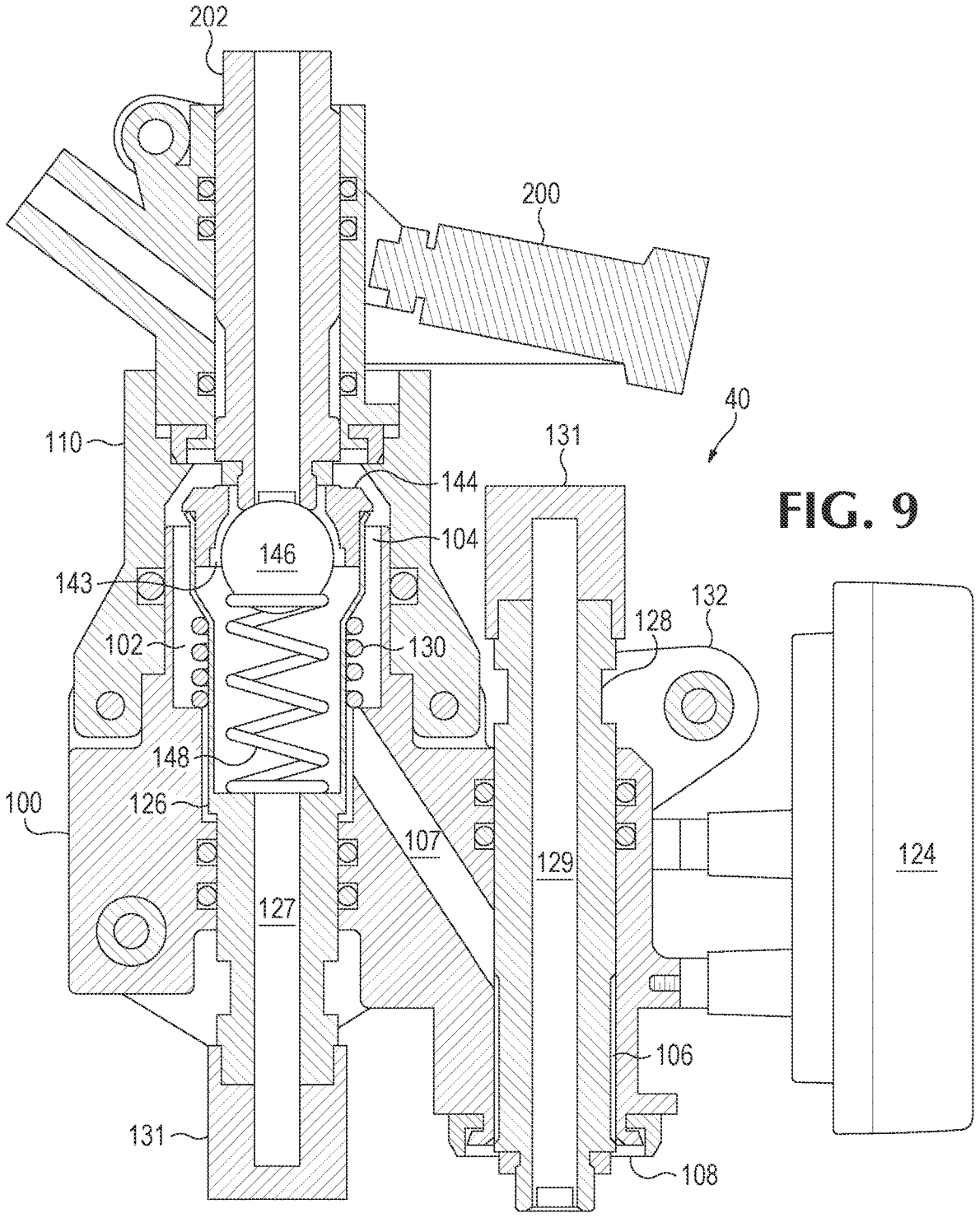
FIG. 9 is the partial sectional view of FIG. 8, showing the keg dispensing coupler in an open position.

Referring to FIGS. 8-9, keg sensor 40 includes a valve assembly 142 disposed within an upper shaft opening 143 of upper shaft 126. The valve assembly includes a collar 144 received in upper shaft opening 143. Collar sits on shoulder 145 of the upper shaft such that, when the spear of the keg dispensing coupler contacts the collar and moves the collar downward, the upper shaft moves downward with the collar. Valve assembly 142 also includes a ball 146 configured to move between a proximal or closed position in which the ball is received in the collar and fluid is prevented from flowing through the collar (see FIG. 8), and a distal or open position in which the ball is spaced from the collar relative to the proximal position and fluid is allowed to flow through the collar (see FIG. 9). Valve assembly 142 further includes a ball spring 148 configured to urge the ball toward the proximal position.

Figure 10:
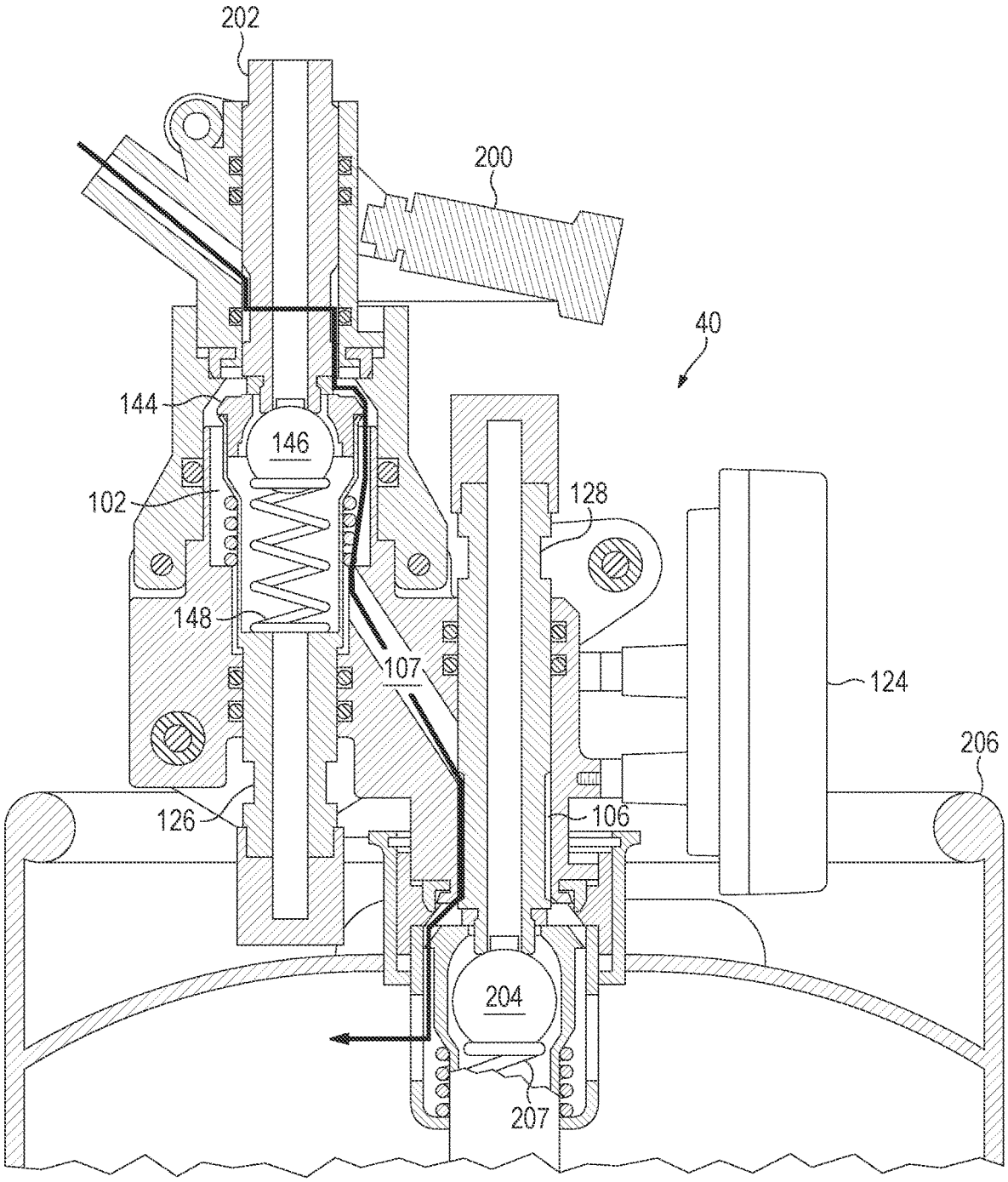
FIG. 10 is the partial sectional view of the keg sensor of FIG. 2, showing an example of a path of the gas that is introduced into the keg to dispense the liquid that is in the keg when the keg dispensing coupler is attached to the keg sensor and is in an open position.
Figure 11:
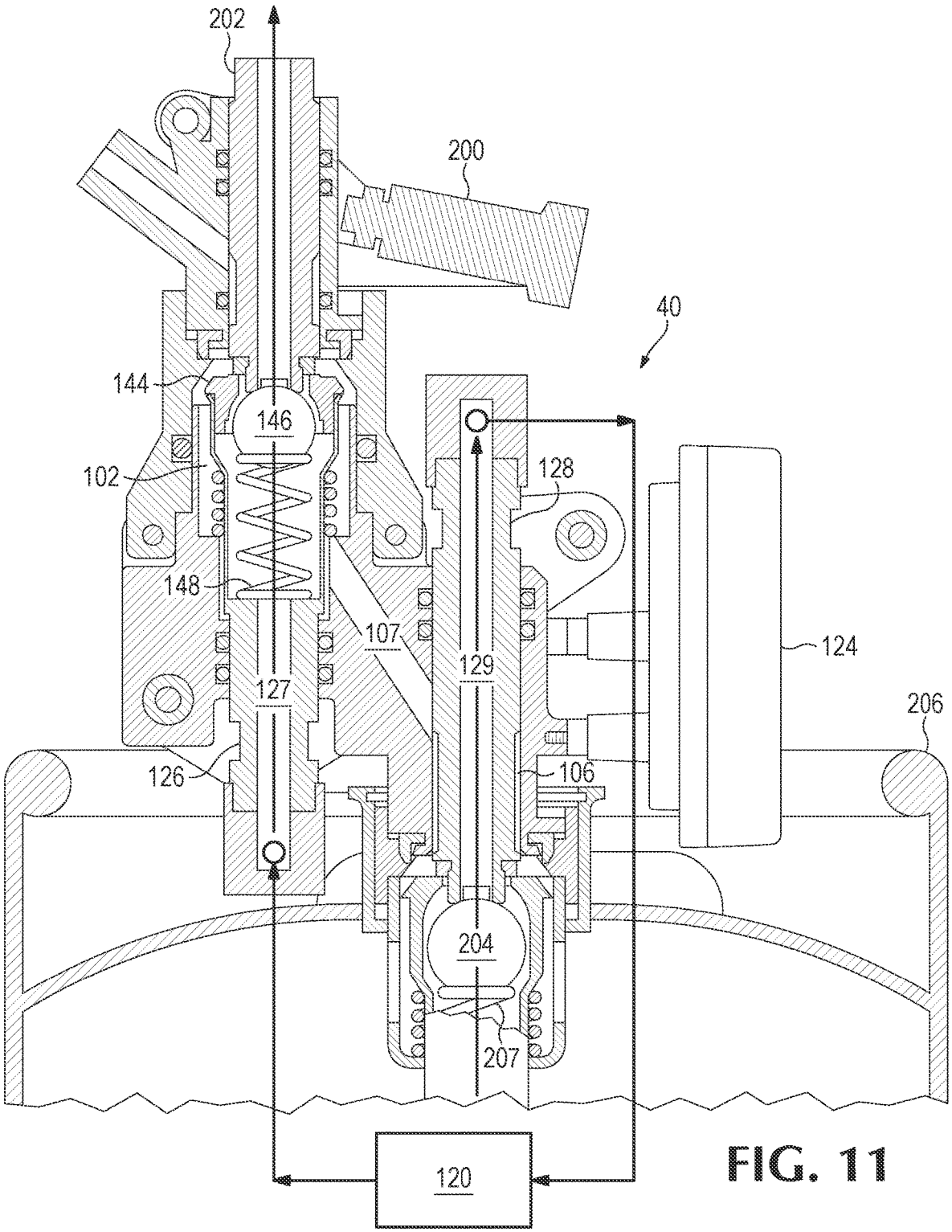
FIG. 11 is the partial sectional view of FIG. 10, showing an example of a path of the liquid dispensed from the keg in response to the gas introduced into the keg in FIG. 10.

When a keg dispensing coupler 200 is attached to spear tap 110 and is in the closed position as shown in FIG. 8, a spear 202 of the keg dispensing coupler is spaced from upper shaft 126 and ball 146. Ball spring 148 urges ball 146 to the proximal position preventing any fluid from flowing through collar 144. When keg dispensing coupler is moved to the open position as shown in FIG. 8, spear 202 of the keg dispensing coupler contacts collar 144 and ball 146 and moves both the upper shaft (via the collar) and the ball away from upper opening 104 (i.e., downward in FIG. 9) against the urging of their respective springs. Movement of ball away from upper opening 104 moves the ball into its distal position in which the ball is spaced from the collar. Additionally, movement of the upper shaft away from the upper opening moves the side levers and the lower shaft toward the lower opening. The lower shaft moves keg ball 204 within keg 206 against the urging of keg ball spring 207. With ball 146 and keg ball 204 moved away from their respective collars, gas (e.g., carbon dioxide, nitrogen, mixture of carbon dioxide and nitrogen, etc.) is allowed to enter the keg through the keg dispensing coupler and first channel 102 external the upper shaft, through third channel 107, through second channel 106 external lower shaft 128 and into the keg, as shown in FIG. 10. Once the gas is introduced into the keg, liquid (e.g., beer) is dispensed from the keg through the lower shaft channel, the tubing, the upper shaft channel, and the keg dispensing coupler, as shown in FIG. 11.

Keg sensor 40 transmits any suitable data at any suitable frequency regarding keg 206 to the brewery and/or distributor to allow monitoring remaining amounts in the kegs and to check if the liquids from the kegs are being dispensed under optimal conditions. For example, the data transmitted from the keg sensor may include serial number of the keg sensor, counts, flow, temperature, time, and/or location (from router). The software installed in the smart phones, tablets, or computers at the brewery and/or distributor may analyze and/or display the serial numbers of the kegs, the types of liquids (e.g., beer) in those kegs, the volumes remaining (such as based on counts), the pour volume for each dispensing action, the pour/dispensing frequency, operating hours, temperature, and time estimate when the kegs will be empty. Alarms may be provided by the software for data outside of optimal and/or acceptable ranges, such as based on temperature (e.g., the liquid is being dispensed from a keg outside the acceptable temperature range), operating hours (e.g., liquid is being dispensed from a keg during a time when the dispensing location should be closed or not operating), volume (e.g., the keg is empty or almost empty), wrong location (e.g., a keg with a particular serial number is at the wrong location based on the location's router identification number), and expiration date (e.g., liquid from a keg is being dispensed after the expiration date of that liquid or the keg).

Figure 12:
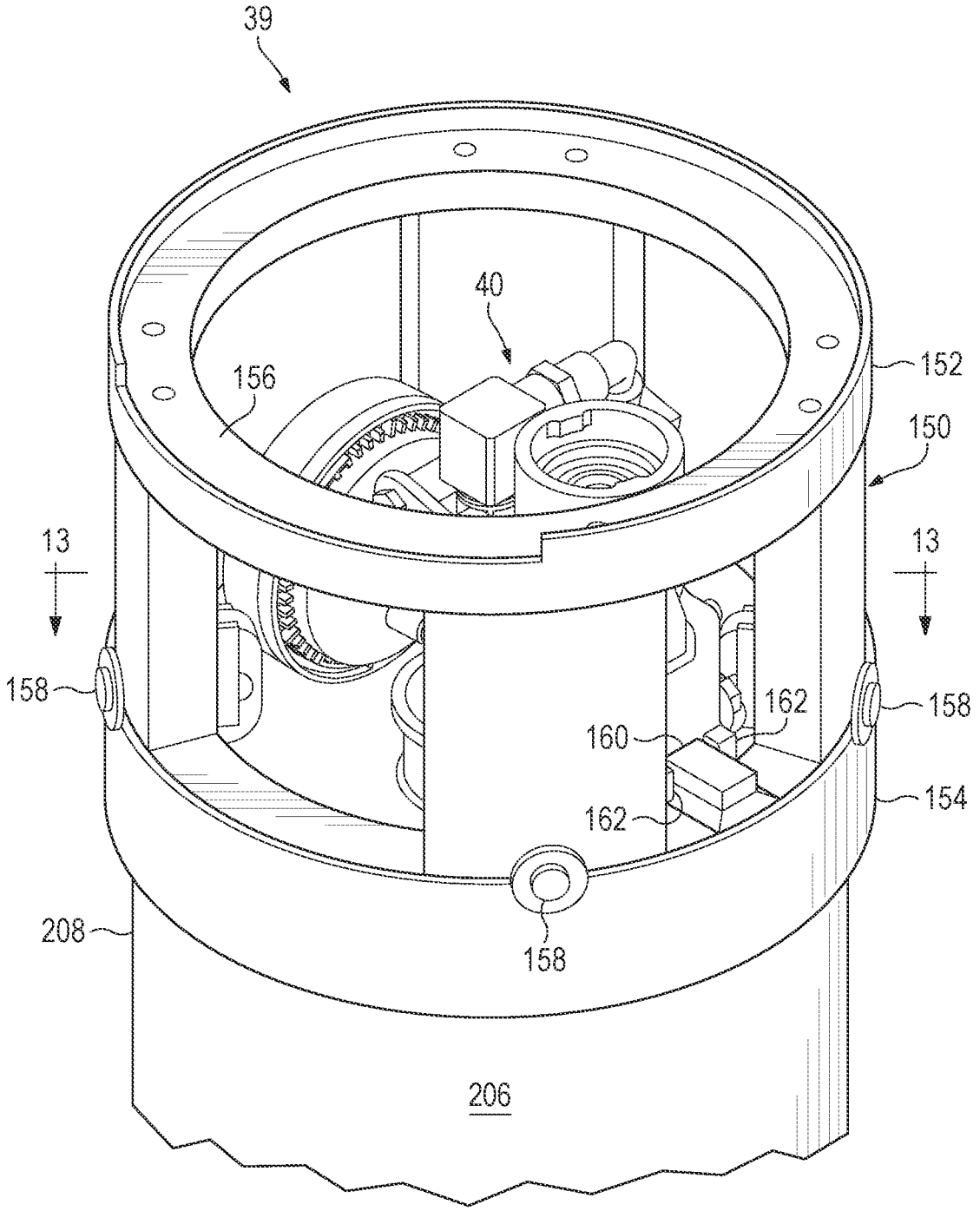
FIG. 12 is a partial isometric view showing the keg sensor of FIG. 2 and an example of a stack cage assembly attached to a keg.
Figure 13:
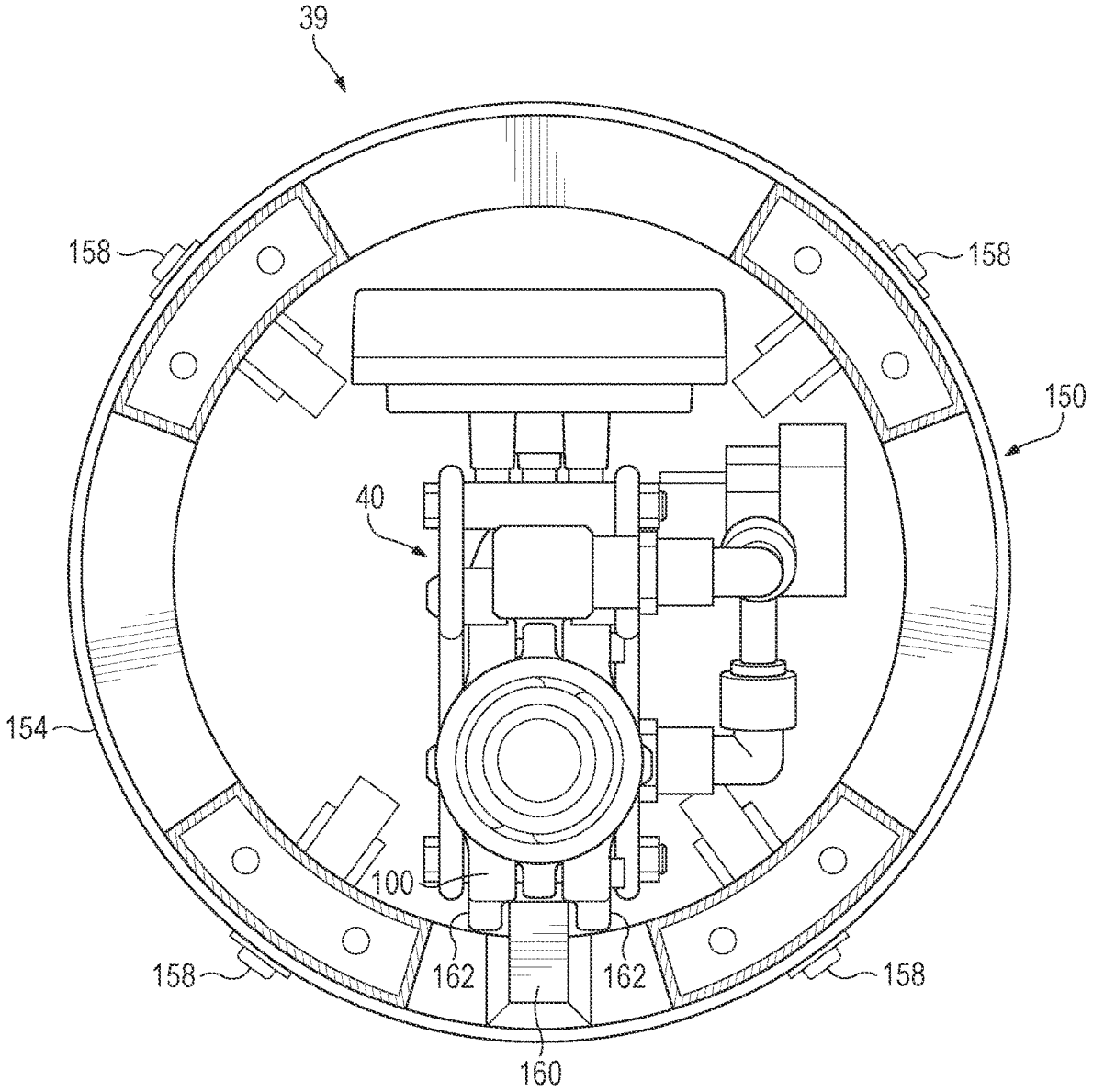
FIG. 13 is a top view of the keg sensor and stack cage assembly of FIG. 12.

Referring to FIGS. 12-13, keg sensor assembly 39 includes, in some embodiments, a stack cage assembly 150. The stack cage assembly includes a cage 152 that is sized to surround keg sensor 40 when keg sensor 40 is attached to the keg to protect the keg sensor. The cage may be sized for any suitable size keg 206, such as a six barrel keg, a ½ barrel keg, or a ¼ barrel keg. Cage 152 includes a lower channel 154 that is configured to receive an upper portion 208 of keg 206, such as the keg collar. Cage 152 also includes an upper channel 156 that is configured to receive or support a lower portion of another keg, such as when the kegs are vertically stacked. Cage 152 is attached to the upper portion of the keg via tamper-resistant fasteners 158, such as tamper resistant screws (e.g., with breakaway heads and/or one-way screw drives).

In some embodiments, stack cage assembly 150 includes an anti-rotation element 160 (such as a pin or projection) adjacent to lower channel 154. The anti-rotation element is disposed between projections 162 of main body 100 when keg sensor 40 is attached to keg 206 to prevent accidental or intentional rotation and subsequent removal of the keg sensor.

Although the disclosed keg sensor assemblies have been shown and described with reference to the foregoing operational principles and preferred embodiments, it will be apparent to those skilled in the art that various changes in form and detail may be made without departing from the spirit and scope of the disclosure. The present disclosure is intended to embrace all such alternatives, modifications and variances that fall within the scope of the appended claims. For example, the keg sensor may include one or more regulators or flow controllers (such as a regulator for $CO_2$ and/or for beer) that will regulate and/or control flow of gases into the keg and/or liquid dispensed from the keg. The above regulators may be instead of, or in addition to, regulators at the dispensing locations. In some embodiments, the regulator(s) may be adjusted by the brewery and/or distributor based on the type of liquid contained in the keg to ensure optimal or "perfect" pours at the dispensing location.

Numbered paragraphs that further define the keg sensor assemblies of the present disclosure are provided below.

A1. A keg sensor, comprising:

a main body;

a first connector attached to the main body and configured to be connected to a dispensing coupler, the dispensing coupler configured to be moved between a closed position and an open position;

a second connector attached to the main body and configured to be connected to a valve of a keg; and a sensor assembly attached to the main body and configured to detect one or more operating parameters of liquid dispensed from the keg through the keg sensor.

A2. The keg sensor of paragraph A1, wherein the first connector is configured to be connected to a Sankey coupler type D.

A3. The keg sensor of any of paragraphs A1-A2, wherein the second connector is configured to be connected to a Sankey valve type D.

A4. The keg sensor of any of paragraphs A1-A3, wherein the sensor assembly includes a flow meter configured to detect flow of liquid dispensed from the keg through the keg sensor.

A5. The keg sensor of any of paragraphs A1-A4, wherein the sensor assembly includes a temperature sensor configured to detect temperature of the main body.

A6. The keg sensor of any of paragraphs A1-A4, wherein the sensor assembly includes a temperature sensor configured to detect temperature of the liquid dispensed from the keg through the keg sensor.

A7. The keg sensor of any of paragraphs A1-A6, wherein the main body includes a first channel having an upper opening, a second channel having a lower opening, and wherein the keg sensor further comprises:

an upper shaft slidably received in the first channel and configured to move away from the upper opening when a coupler is connected to the first connector and moved to the open position;

a lower shaft slidably received in the second channel; and at least one side lever pivotably attached to the main body and attached to the upper and lower shafts such that, when the upper shaft moves away from the upper opening, the lower shaft moves toward the lower opening.

A8. A keg sensor assembly, comprising:

the keg sensor of any of paragraphs A1-A7; and a stack cage and lock system, including a cage sized to surround the keg sensor, the cage having upper and lower channels, the lower channel being configured to receive an upper portion of the keg and the upper channel being configured to support a lower portion of another keg.

A9. The keg sensor assembly of paragraph A8, wherein the stack cage and lock system further includes an anti-rotation element, wherein the main body of the keg sensor includes two protruding portions and the anti-rotation element is disposed between the two protruding portions to prevent rotation of the keg sensor relative to the stack cage and lock system.

A10. The keg sensor assembly of paragraph A9, wherein the anti-rotation element includes a pin sized to fit between the two protruding portions.

Other illustrative examples of keg sensors, keg sensor assemblies, and methods of operating keg sensors and keg sensor assemblies are shown in Appendices A-C. However, the present disclosure is not limited to the examples shown and described in those appendices.

The specific embodiments disclosed and illustrated herein are not to be considered in a limiting sense as numerous variations are possible. The subject matter of the present disclosure includes all novel and non-obvious combinations and subcombinations of the various elements, features, functions and/or properties of the embodiments disclosed herein. Similarly, where the claims recite "a" or "a first" element or the equivalent thereof, such claims should be understood to include incorporation of one or more such elements, neither requiring nor excluding two or more such elements.

Various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the present disclosure.

What is claimed is:

1. A keg sensor, comprising:

a main body having opposed first and second end portions;

a first connector attached to, or formed with, the first end portion of the main body and configured to be connected to a keg dispensing coupler;

a second connector attached to, or formed with, the second end portion of the main body and configured to be connected to a valve of a keg; and a sensor assembly disposed between the first and second connectors and attached to the main body, the sensor assembly being configured to detect one or more operating parameters of liquid dispensed via the keg dispensing coupler from the keg through the keg sensor.

2. The keg sensor of claim 1, wherein the main body includes a first channel having an upper opening, a second channel having a lower opening, and a third channel fluidly connecting the first and second channels, wherein the second channel is spaced and parallel to the first channel.

3. The keg sensor of claim 2, further comprising:

an upper shaft slidably received in the first channel and configured to move away from the upper opening when the keg dispensing coupler is connected to the first connector and moved to an open position;

a lower shaft slidably received in the second channel;

at least one side lever pivotably attached to the main body and attached to the upper and lower shafts such that, when the upper shaft moves away from the upper opening, the lower shaft moves toward the lower opening; and a first spring positioned within the first channel and configured to urge the upper shaft toward the upper opening, wherein the upper shaft is configured to move away from the upper opening, against urging from the first spring, when the keg dispensing coupler is connected to the first connector and moved to an open position.

4. The keg sensor of claim 3, wherein the upper shaft includes an opening adjacent to the first connector, wherein the keg sensor further comprises:

a collar received in the opening;

a ball configured to move between a proximal position in which the ball is received in the collar, and a distal position in which the ball is spaced from the collar relative to the proximal position; and a second spring configured to urge the ball toward the proximal position.

5. The keg sensor of claim 4, wherein the ball is moved from the closed position to the open position against the urging of the second spring when the keg dispensing coupler is connected to the first connector and moved to the open position.

6. The keg sensor of claim 1, further comprising tubing that is external the main body and fluidly connects the first and second channels.

7. The keg sensor of claim 6, wherein the sensor assembly is external the main body and is attached to the tubing.

8. The keg sensor of claim 1, wherein the first connector is configured to be connected to a Sankey coupler type D.

9. The keg sensor of claim 8, wherein the second connector is configured to be connected to a Sankey valve type D.

10. The keg sensor of claim 1, wherein the sensor assembly includes a flow meter configured to detect flow of liquid dispensed, via the keg dispensing coupler, from the keg through the keg sensor.

11. The keg sensor of claim 10, wherein the sensor assembly further includes a temperature sensor configured to detect temperature of the liquid dispensed, via the keg dispensing coupler, from the keg through the keg sensor.

12. A keg sensor assembly, comprising:

the keg sensor of claim 1; and a stack cage assembly including a cage sized to surround the keg sensor, the cage having upper and lower channels, the lower channel is configured to receive an upper portion of the keg and the upper channel is configured to support a lower portion of another keg.

13. The keg sensor assembly of claim 12, wherein the stack cage assembly further includes an anti-rotation element, wherein the main body of the keg sensor includes two protruding portions and the anti-rotation element is disposed between the two protruding portions when the lower channel of the stack cage and lock system is received in the upper portion of the keg.

14. The keg sensor assembly of claim 13, wherein the anti-rotation element is a pin sized to fit between the two protruding portions.

* * * * *